United States Patent [19]

Golomb

[11] Patent Number: 4,603,439

[45] Date of Patent: Aug. 5, 1986

[54] BOXING GLOVE

[75] Inventor: John C. Golomb, Brooklyn, N.Y.

[73] Assignee: Everlast World's Boxing Headquarters Corp., New York, N.Y.

[21] Appl. No.: 679,620

[22] Filed: Dec. 10, 1984

Related U.S. Application Data

[63] Continuation of Ser. No. 599,537, Apr. 12, 1984, abandoned, which is a continuation of Ser. No. 543,103, Oct. 18, 1983, abandoned, which is a continuation of Ser. No. 290,822, Aug. 7, 1981, abandoned.

[51] Int. Cl.[4] ..... A41D 13/10

[52] U.S. Cl. ..... 2/18

[58] Field of Search ..... 2/18

[56] References Cited

U.S. PATENT DOCUMENTS

| | | | |
|---|---|---|---|
| 404,929 | 6/1889 | O'Sullivan | 2/18 |
| 608,434 | 8/1898 | Wood | 2/18 |
| 961,149 | 6/1910 | Maynard . | |
| 1,534,906 | 4/1925 | Bridgewater . | |
| 2,284,300 | 5/1942 | Portal . | |
| 2,416,444 | 2/1947 | Hilton | 2/18 |
| 2,556,759 | 6/1951 | Hilton . | |
| 3,540,059 | 11/1970 | Kennedy | 2/18 |
| 4,295,228 | 10/1981 | Dragomir | 2/18 |
| 4,424,595 | 1/1984 | Albert | 2/18 |
| 4,425,668 | 1/1984 | Wen-Jen et al. | 2/18 |

OTHER PUBLICATIONS

Martino, U.S. copyright registration No. VAU-14-340.

*Primary Examiner*—Louis K. Rimrodt

*Attorney, Agent, or Firm*—Yuter, Rosen & Dainow

[57] ABSTRACT

A boxing glove having an inner glove into which a boxer's hand is insertable, an outer shell conforming generally to the inner glove and defining therebetween a space, and padding secured between the inner glove and outer shell, the boxing glove further including a thumb pocket of the inner glove for receiving the boxer's thumb and allowing movement thereof relative to the remaining parts of the boxing glove, and a web of flexible sheet material secured to the boxing glove and generally encompassing the thumb pocket for substantially preventing the thumb pocket from protruding from the remainder of the boxing glove.

12 Claims, 8 Drawing Figures

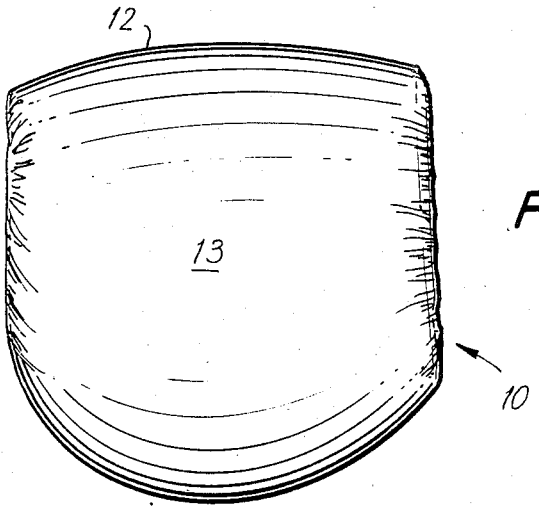
FIG. 1
FIG. 2
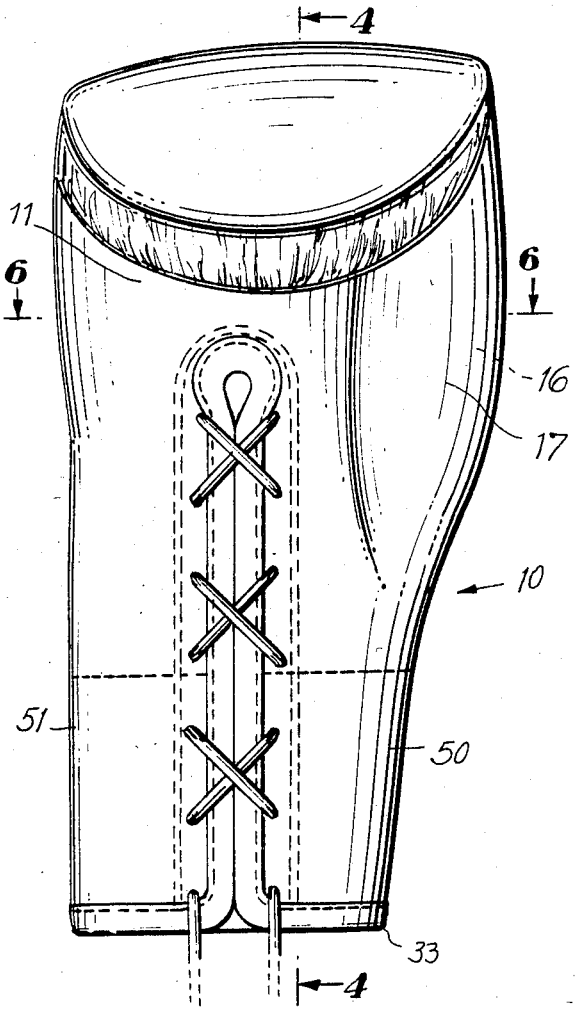
FIG. 3
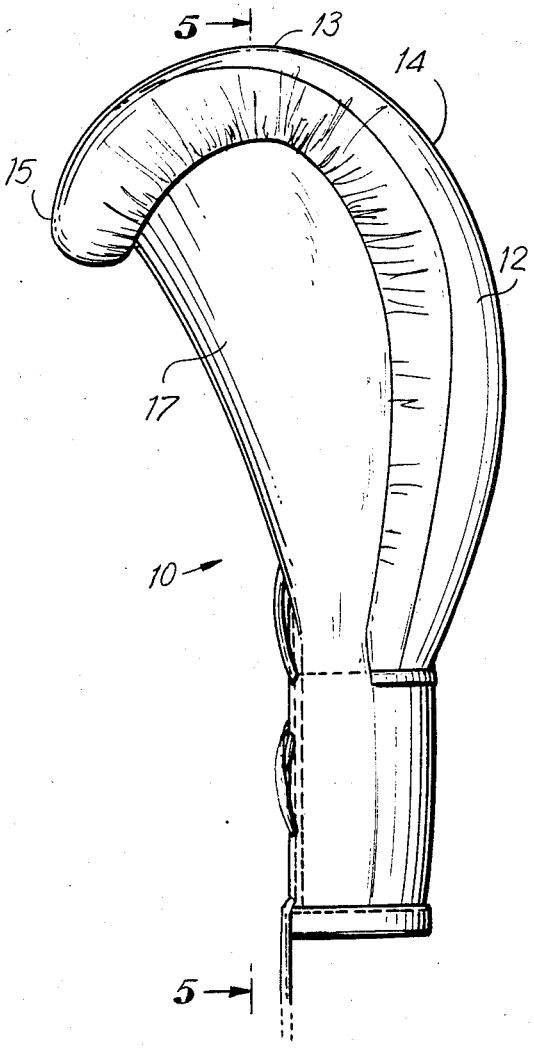

BOXING GLOVE

This application is a continuation of application Ser. No. 599,537, filed Apr. 12, 1984, which is a continuation of application Ser. No. 543,103, filed Oct. 18, 1983, which is a continuation of application Ser. No. 290,822, filed Aug. 7, 1981, all now abandoned.

BACKGROUND OF THE INVENTION

This invention is in the field of boxing gloves as used in amateur and professional boxing matches and for training purposes. Traditionally, such gloves include an inner glove or mitt into which the boxer's hand is inserted and snugly fits whereby the glove is securely engaged to his hand and cannot twist, slide or otherwise move relative to the hand. Encompassing the inner glove is an outer shell spaced apart from the inner glove by a thickness of padding which may range from a fraction of an inch to numerous inches.

The padding is intended to be a protective cushion to prevent damage to the boxer's hand as he strikes training targets or another boxer, and to prevent damage to the boxer's opponents who are struck. The amount, type and quality of padding varies from a tiny amount in the case of bag gloves which merely protect the skin of the boxer's hand during training against punching bags, to very large, thick amounts of padding for training gloves to maximize the cushioning protection from damage, and finally to an intermediate amount of padding such that the gloves weight 8 ounces as is required in typical professional boxing matches. The composition of padding is typically polyfoam, polyvinyl chloride (PVC) closed cell and open cell layers and hair substances such as horse hair. Typically the outer shell surface layer of the glove is soft but durable leather or vinyl, and the inner glove is a very strong cotton or equivalent material.

In boxing glove construction the thumb portion has been one area of particular interest and concern because of the potential danger to the eyes of a boxer's opponent if struck by an extended thumb. Eye injuries have been among the most frequent and serious of injuries in this sport and are of great concern not only because of the temporary or permanent physical suffering, but because the livelihood of professional boxers is at stake. Prevention of injuries to boxers' thumbs is obviously also a matter of substantial concern.

Some early gloves consisted of a mass or ball of padding with a central cavity into which the user's hand was inserted and a transverse bar secured within the cavity to be gripped. Most boxing gloves provide thick padding adjacent all striking surfaces, such as the knuckles, back and side of the hand, finger tips and thumb. In all cases an objective is for the glove to be comfortable and protective, but also to be grippable so that it is snug and secure on the fist and cannot twist or slide relative to the user's hand. To allow the boxer to feel his fist and glove engagement as comfortable and natural, there must be provision for him to bend and curl his fingers and thumb to form a natural fist while simultaneously providing the massive padding as described earlier.

To achieve the above objectives most boxing gloves retained a separate thumb pocket, which while heavily padded, still allowed for significant numbers of eye injuries. A major improvement in boxing glove design in the prior art is illustrated in FIG. 7 herein, namely the provision of a large padded protrusion on the glove adjacent the fore-finger and extending toward the thumb. The cushion protrusion being closely adjacent to the thumb renders the thumb projection merely part of a larger mass, so that contact of the thumb and an opponent's face inherently involves contact of most of the large cushion mass, thus reducing the possibility of the thumb alone poking into the eye. This design feature has been so affective in reducing injuries that it has been adopted throughout the United States and the world as the standard and often required boxing glove construction in amateur and professional fights.

Despite the improvements within prior art boxing gloves, eye injuries caused by thumbs have not been eliminated. This has led to the present invention of a totally new boxing glove that is more effective in protecting both fighters, while allowing for reasonable comfort and freedom of motion of the thumb and fingers. These and other objectives will be described in connection with the disclosure of the new invention in the following paragraphs.

SUMMARY OF THE INVENTION

The new boxing glove disclosed and claimed herein provides an inner glove with separate pockets for the thumb and the remaining fingers respectively, so that the fist and glove can be firmly and securely coupled, while the thumb retains full freedom of movement to form a natural fist, i.e. with the fingers curled toward the palm and the thumb bent to overlie the curled fingers and to point generally transversely of the direction of the finger tips. Encompassing the inner glove and secured to it is an outer shell preferably of soft but durable leather or vinyl. Between the inner glove and the outer shell, at least on the back side opposite the front or palm side is one or more layers of resilient padding. Finally, a web is provided and secured to the glove to encompass and prevent the thumb from ever projecting dangerously outward, while allowing adequate freedom of movement of the thumb.

For simplicity of design the thumb-covering web may constitute the entire palm surface of the outer shell, so that stitching, folds, shirring or other wrinkling of the exposed glove surfaces are minimized.

An inner layer of relatively soft, light density foam padding is cemented to the outer surface of the back side of the inner glove; this may be supplemented by one or more additional layers of padding adhered to the inner layer. Finally there is an outer layer situated and secured between the inner surface of the outer shell and the inner layer(s) of padding. For convenience and economy in manufacture and effectiveness in use, a generally rectangular shaped pad is used for the outer layer; this provides a wide and smooth striking surface, with a relatively simple and inexpensive construction. In particular we have eliminated the need of the earlier-mentioned cushion projection between the thumb and forefinger, which is a highly irregular shape requiring special cutting, assembly and sewing procedures.

An additional feature in the new construction is a series of ventilation holes through the palm portion of the inner glove. Preferably two lines of holes are provided for the fingers and palm respectively, these lines of holes being separated by the transversely extending gripping rib formed in the palm layer.

In manufacturing this new glove it is contemplated that materials and techniques known in the prior art will be used, except for the novel features described and claimed herein. Further details of the present invention are disclosed with reference to the drawings described below.

DESCRIPTION OF THE DRAWINGS AND PREFERRED EMBODIMENT

FIG. 1 is a top plan view of the new boxing glove;

FIG. 2 is a front elevation thereof;

FIG. 3 is a right side view thereof;

Figure 4:
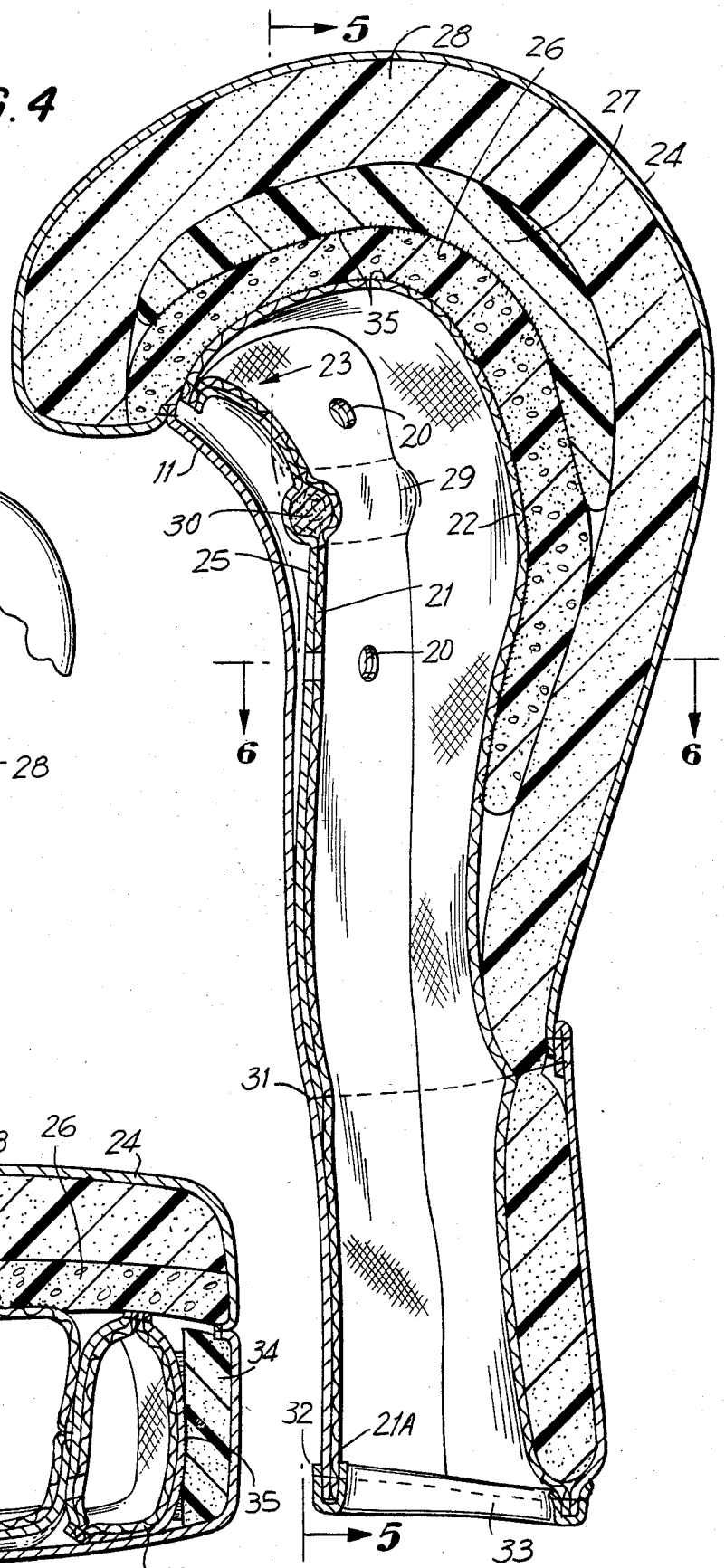
FIG. 4 is a sectional view taken along line 4—4 in FIGS. 2 and 5.

The outer appearance of the new boxing glove 10 is shown in FIGS. 1–3, illustrating the top, front and side views. Pertinent parts or components of the boxing glove include the palm or front part 112, the rear outer shell 12, the top end 13, the rear top portion 14 and front top portion 15. The thumb part 16 is shown in dotted line because it is hidden by view from the web 17 which covers and encompasses the front or palm part of the glove.

Figure 5:
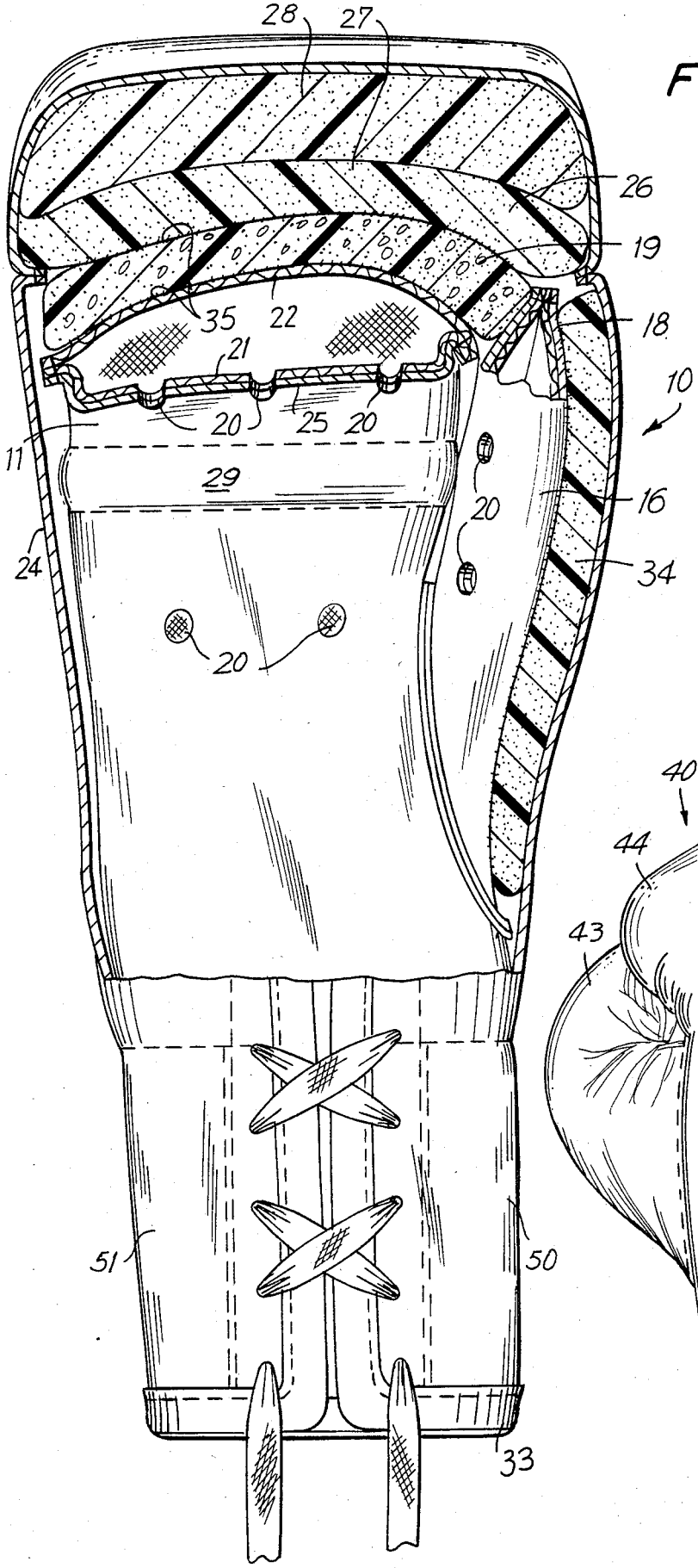
FIG. 5 is a sectional view taken along line 5—5 in FIGS. 4 and 3.

FIG. 5 corresponds to FIG. 2 by illustrating the actual palm portion 11 of the glove with the web 17 removed. Also visible by the omission of the web is the essentially normal thumb part 16 whose top or tip 18 is adjacent the finger tip cushion 19, the palm 11 is shown in FIG. 5, as well as apertures 20 for ventilation.

As is apparent from FIGS. 2 and 4–6 the inner glove comprises a principal or first pocket for receiving the user's hand and fingers and a second or thumb pocket for receiving the user's thumb. These two pockets are generally elongated, having first and second principal longitudinal axes respectively which are generally parallel when a user's hand is in the glove and his fingers and thumb are extended logitudinally. The first pocket is bendable as indicated in FIG. 4 about a first transverse axis generally perpendicular to said first longitudinal axis when the user's fingers in the first pocket are curled inwardly for forming a natural flat as discussed on pages 3, 4, 5 and 8 above. The second pocket is bendable about a second transverse axis which is generally perpendicular to said second longitudinal axis and also transverse to said first transverse axis of said first pocket. The second pocket is thus bendable relative to the first pocket and relative to the remainder of the glove and the web thereof.

The inner construction of the glove is shown in FIG. 4 where an inner glove or mitt is formed by a palm liner 21 and a back liner 22 which are joined together in the finger tip area at 23. The glove has an outer shell comprising a back part 24 and a palm part 25 also joined at the general area of the finger tips 23. The outer shell is normally made of a durable leather or vinyl. Between the back liner 22 and the back shell 24 are layers of padding comprising a first layer 26 made of very light density open cell polyfoam cemented to the back liner along the junction therebetween. Next is a layer of closed cell, medium density polyvinyl chloride (PVC) indicated by reference 27 which is cemented to layer 26 along their common surface. Finally is the layer 28 of closed cell, light density PVC about ¾ of an inch thick which is not cemented but is merely inserted into the space defined by outer shell 24 and the outside surface of layer 27. A transverse rib 29 is formed by forming a pocket between palm liner 21 and palm shell 25 and filling same with a polyfiber 30, this rib providing a firm and semi-flexible bar which the boxer's finger tips can curl around to securely engage the glove from the inside. Finally the web 11 is shown which is attached to the inner surface of the glove in the vicinity of the injunction 23 and extends down to the cuff junction at 31 and hence to the bottom end of the glove at 32 where it is secured to the end of palm liner 21A in a binding 23.

Figure 8:
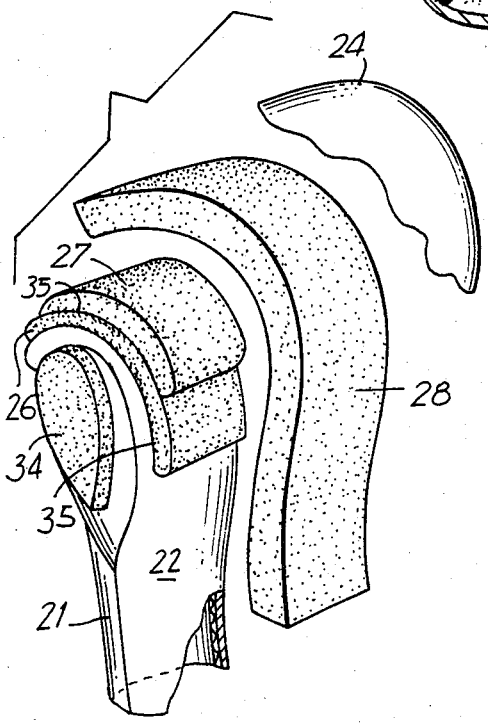
FIG. 8 is an exploded view in perspective of the inner glove and padding of the glove of FIGS. 1–6.
Figure 6:
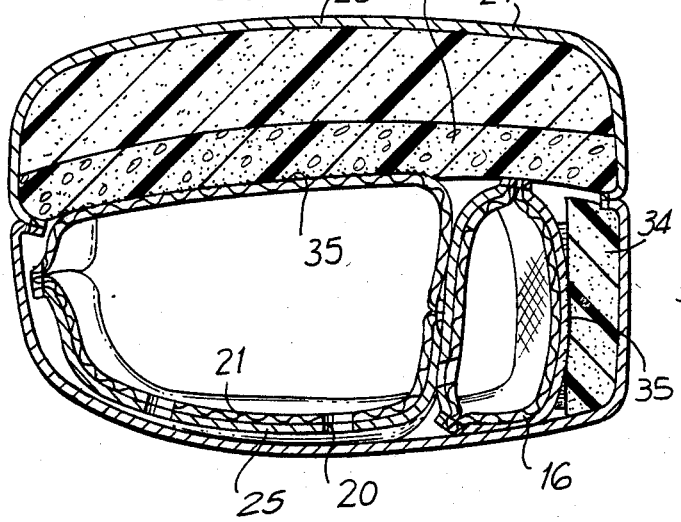
FIG. 6 is a sectional view taken along line 6—6 in FIG. 4.

Also shown in FIG. 6 is additional padding 34 which is a slab or layer of PVC on the outside surface of the thumb pocket, the thumb 16 being formed by outer and inner layers similarly as the inner mitt. A further clarification of the glove construction is shown in FIG. 8 where the inner glove comprises palm and outer layers 21 and 22 respectively, with foam layers 26, 27 and 28 added in order. To secure layer 26 to 22, 27 to 26 and 34 to the inner thumb, suitable cement 35 is used, as shown in FIGS. 4 and 8.

For actual construction of this boxing glove prior art materials and techniques may be selected, as suggested in assignee's co-pending application, Ser. No. 138,205 (U.S.). More particularly, layer 28 is a flexible ¾ inch thick PVC foam of the type available from the Airex Division of Lonza Corporation #S32.50 and #S30.50; the inner layers may be obtained from the Rubatex Corporation #R313-V.* Foam layers of these types provide adequate resilient cushioning without the requirement of hair adding which is more difficult and expensive to use in mass produced boxing gloves. The innermost foam layer is relatively soft to conform to and comfortably cushion the boxer's fist. The outermost layer is firmer and stronger, and the middle layer is the strongest PVC closed cell structure, substantially enhancing durability of the final assembled glove.

Figure 7:
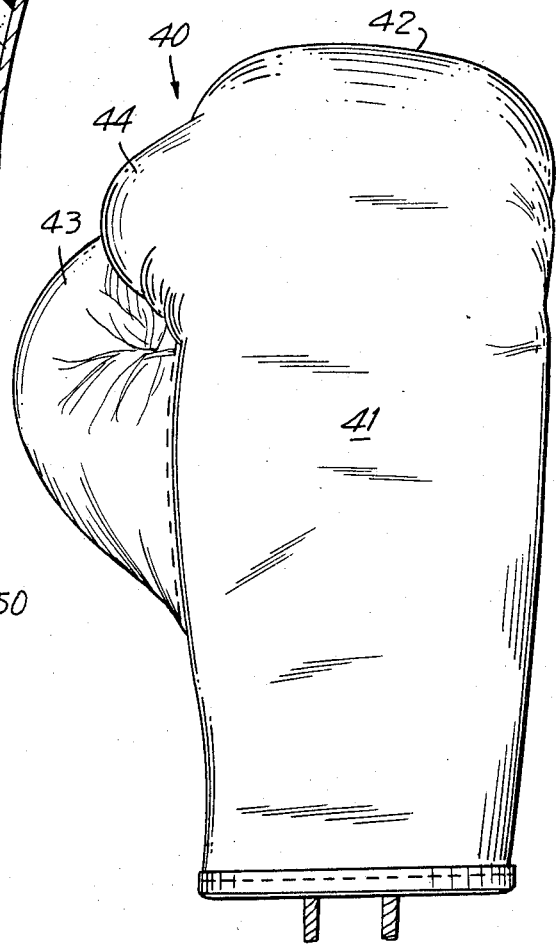
FIG. 7 is a rear elevation view of a prior art boxing glove.

FIG. 7 illustrates a typical prior art boxing glove 40 showing the back side 41 the top 42 and the thumb 43. In this design the thumb is a freely movable pocket extending laterally upwardly from the remaining of the portion of the glove; however close adjacent to the end of the thumb is a lateral projection or knuckle 44 which is filled with cushioning material to form a large relatively soft surface generally continuous with the thumb thereby rendering it difficult for the thumb to accidentally poke an opponents eye.

FIG. 2 further shows pockets 50 and 51 into which is inserted hog hair or equivalent until the glove has the desired weight; usually the final total glove weight is between 8 and 16 oz.

The new boxing glove disclosed herein may be made with a variety of suitable materials and in a variety of modifications within the scope and spirit of the claims appended hereto as follows.

I claim:

1. In a boxing glove including an inner glove having a principal pocket for receiving the user's hand and fingers and a second pocket for receiving the user's thumb, an outer shell generally encompassing and secured to the inner glove with a space defined between corresponding parts of the inner glove and outer shell, and a quantity padding secured in said space, said outer shell defining a back side and an opposite palm side, the improvement comprising a web of flexible sheet material encompassing said thumb and at least part of said palm side and secured to said boxing glove, and said second pocket being bendable relative to said principal pocket and relative to said web, said principal pocket being bendable about a first axis, said second pocket being bendable about a second axis generally perpendicular to the first axis.

2. A boxing glove according to claim 1 wherein said boxing glove defines a top end for receiving and encompassing the user's finger tips and a bottom end formed as a cuff for encompassing the user's wrist, said web encompassing substantially said entire palm side of said glove from said top end to said cuff.

3. A boxing glove according to claim 1 wherein said back side of the outer shell and said web, each comprise a layer of leather or plastic.

4. A boxing glove according to claim 3 wherein said inner glove back and palm sides comprise sheets of cotton fabric.

5. A boxing glove according to claim 1 wherein said inner glove defines a palm side and a back side corresponding to those of said outer shell, and said padding comprises inner layer of foam adhered to said back side of said inner glove and an outer layer of foam positioned between said inner layer and said back side of said outer shell.

6. A boxing glove according to claim 5 wherein said outer layer of foam is generally rectangular and extends from said top end of the boxing glove to said cuff thereof.

7. A boxing glove according to claim 4 wherein said first inner layer of foam comprises a light density open cell polyfoam cemented to said back liner, said padding further comprises a second inner layer of closed cell medium density polyvinyl chloride cemented to said first inner layer, and said outer layer comprises a closed cell, light density polyvinyl chloride loosely positioned between said second inner layer and said outer shell.

8. A boxing glove according to claim 7 wherein said outer layer of foam extends from said top end of said boxing glove to said cuff thereof.

9. A boxing glove according to claim 4 wherein said outer layer of foam extends from said top end of said boxing glove to said cuff thereof.

10. A boxing glove according to claim 1 wherein said palm side of said inner glove includes a plurality ventilation apertures therethrough.

11. A boxing glove including an outer shell defining a top end, backside, a palm side and a thumb pocket, the top end, back and palm sides defining therein a principal cavity for a user's hand and fingers excepting the thumb, the thumb pocket defining a second cavity for the user's thumb, at least one layer of resilient padding inward and adjacent said back side and top end, and a web encompassing said thumb pocket and secured to said outer shell, with said thumb pocket remaining bendable relative to said outer shell and relative to said web, said first and second pockets of said inner glove being bendable when the user's hand in said glove forms a natural fist such that when said fingers are curled inward said thumb wraps about and overlies said curled fingers, a first axis being defined about which said fingers curl, a second axis being defined about which said thumb wraps, said first and second axes being mutually transverse and generally perpendicular.

12. In a boxing glove including an inner glove having a principal first pocket for receiving the user's hand and fingers and a second pocket for receiving the user's thumb, an outer shell generally encompassing and secured to the inner glove with a space defined between corresponding parts of the inner glove and outer shell, and a quantity of padding secured in said space, said outer shell defining a back side and an opposite palm side, the improvement comprising a web of flexible sheet material encompassing said thumb and at least part of said palm side and secured to said boxing glove, said first and second pockets being generally elongated and having first and second principal longitudinal axes respectively which are generally parallel when a user's hand is in the glove and his fingers and thumb are extended longitudinally, said first pocket being bendable about a first transverse axis generally perpendicular to said first longitudinal axis when the user's fingers in said first pocket are curled inwardly for forming a natural fist, said second pocket being bendable about a second transverse axis which is generally perpendicular to said second longitudinal axis and also transverse to said first transverse axis, said second pocket thus being bendable relative to said frist pocket and relative to said glove and web thereof.

* * * * *

UNITED STATES PATENT AND TRADEMARK OFFICE

CERTIFICATE OF CORRECTION

PATENT NO. : 4,603,439

DATED : August 5, 1986

INVENTOR(S) : JOHN C. GOLOMB

It is certified that error appears in the above-identified patent and that said Letters Patent is hereby corrected as shown below:

Column 2, Line 9, change "affective: to -- effective--.

Column 3, line 26, omit "by view from" and insert -- from view by --.

Column 3, line 47, delete "on pages 3, 4, 5 and 8".

Column 4, line 42, delete "of the".

Column 4, line 43, change "close" to -- closely --.

Column 4, line 48 change "opponents" to -- opponent's --.

Column 6, line 2, after "plurality" insert -- of --.

UNITED STATES PATENT AND TRADEMARK OFFICE

CERTIFICATE OF CORRECTION

PATENT NO. : 4,603,439

DATED : August 5, 1986

INVENTOR(S) : JOHN C. GOLOMB

It is certified that error appears in the above-identified patent and that said Letters Patent is hereby corrected as shown below:

Column 3, line 23, change "112" to -- 11 --.

Column 3, line 46, change "flat" to -- fist --.

Column 4, line 32, change "adding" to -- padding --.

Column 5, line 23, after "comprises" insert -- a first --.

Column 6, line 45, change "frist" to -- first --.

Signed and Sealed this

Fourteenth Day of April, 1987

*Attest:*

DONALD J. QUIGG

*Attesting Officer*

*Commissioner of Patents and Trademarks*